US005697354A

United States Patent [19]

Kato

[11] Patent Number: 5,697,354

[45] Date of Patent: Dec. 16, 1997

[54] MARINE ENGINE FUEL CONTROL SYSTEM

[75] Inventor: Masahiko Kato, Hamamatsu, Japan

[73] Assignee: Sanshin Kogyo Kabushiki Kaisha, Hamamatsu, Japan

[21] Appl. No.: 612,084

[22] Filed: Mar. 7, 1996

[30] Foreign Application Priority Data

Mar. 7, 1995 [JP] Japan ..... 7-046902

[51] Int. Cl.[6] ..... F02D 41/14

[52] U.S. Cl. ..... 123/687; 123/687

[58] Field of Search ..... 123/332, 333, 123/672, 679, 687

[56] References Cited

U.S. PATENT DOCUMENTS 4,646,699 3/1987 Yasuoka et al. ..... 123/687
4,877,006 10/1989 Noguchi et al. ..... 123/687
4,993,393 2/1991 Hosoda et al. ..... 123/687
5,220,904 6/1993 Miyashita et al. ..... 123/687
5,253,630 10/1993 Akazaki et al. ..... 123/687
5,375,583 12/1994 Meyer et al. ..... 123/687
5,492,106 2/1996 Sharma et al. ..... 123/687

*Primary Examiner*—Willis R. Wolfe
*Attorney, Agent, or Firm*—Knobbe, Martens, Olson & Bear LLP

[57] ABSTRACT

A feedback control system for an internal combustion engine that includes an arrangement for determining when the output of the fuel-air ratio sensor may not be desirable for main engine control, and switches between an open control and a feedback control in response to those conditions. In addition, transitional running is improved when operating after long predetermined low-speed running so as to result in a quicker return to the desired fuel-air ratio.

26 Claims, 5 Drawing Sheets

MARINE ENGINE FUEL CONTROL SYSTEM

BACKGROUND OF THE INVENTION

This invention relates to an engine fuel control system and method and more particularly to an improved marine engine fuel control system and method.

In the interest of providing good fuel economy and better exhaust emission control, it has been proposed to control the fuel/air ratio of an engine through the incorporation of an air/fuel ratio sensor and a feedback control system that operates to maintain the desired, normally stoichiometric, fuel/air ratio in response to the sensor output. The fuel/air ratio may be determined by a number of methods and one of the more commonly used methods employ an oxygen ($O_2$) sensor in the exhaust system for the engine. By sensing the amount of oxygen in the exhaust, it is possible to determine the actual fuel/air ratio.

These systems provide very effective control and are quite useful. However, when the adjustments are made in fixed increments or in a fixed ratio, then certain problems can arise under specific types of running conditions. For example, if the engine is operated at a long time at a relatively low speed, then the engine itself may tend to run on the rich side, even with a feedback control. Thus, the normal incremental adjustments may be insufficient to bring the mixture to the desired ratio at a quick enough time to achieve the desired results.

It is, therefore, a principal object of this invention to provide an improved feedback control system and method that is adaptable to suit conditions when the engine has been operating at a low speed for a long time period.

This type of problem is particularly acute in conjunction with marine applications. In marine applications it is frequently the case where the engine is operated at idle or a slower speed than idle for long time periods. For example, this may occur when trolling. Thus, upon return to normal speed, the mixture ratio may not be returned to the desired ratio as quickly as desired with conventional feedback control systems.

It is, therefore, a still further object of this invention to provide an improved feedback control system for an engine that is more responsive to return to normal running from long low-speed running conditions.

Most sensors utilize for determining air/fuel ratio including oxygen sensors also are not fully reliable until they reach a temperature that is greater than a predetermined normal operating temperature. Therefore, during time periods when the sensor is not believed to be reliable, it is often the practice to resort to an open control strategy. Under this control, the fuel/air ratio is set based upon engine running conditions such as speed, load, etc. Frequently, the open running conditions tend to set the mixture somewhat richer than normal so as to ensure against possible engine damage.

On many types of systems, the engine on initial starting and for a predetermined time period is operated on an open control system. Thereafter, and when the engine is determined to be at a condition when the output of the sensor is accurate, it switches over to a feedback control. When, however, the engine has been running at a low speed for this initial warmup period, the switch over to feedback control may not result in the quick return of the fuel/air ratio to the desired ratio. This is in part because the maximum step adjustment for feedback control may be limited more than desirable under this particular running condition.

It is, therefore, a still further object of this invention to provide an improved arrangement for transitioning to feedback control when operating under a long time period at low speeds.

In addition to the start-up phase, there may be other times when the output of the oxygen sensor is not particularly reliable for feedback control. Another condition when this can occur also is prompted by continued low-speed running. Under such conditions, the sensor may become contaminated with carbon buildup due to the low temperature. In addition, the temperature of the sensor may also drop so that its output is unreliable. If feedback control is maintained during this time period, then the mixture will be unduly lean and poor running and other problems may result.

It is, therefore, a still farther object of this invention to provide an improved arrangement for resorting to an open control at such times when the engine has been run at low speeds for a long time period and the output of the sensor may be unreliable.

SUMMARY OF THE INVENTION

A number of features of the invention are adapted to be embodied in a feedback control system and method for an internal combustion engine that has a combustion chamber. A fuel-air supply system supplies a fuel-air charge to the combustion chamber. A combustion condition sensor is provided for determining the fuel-air ratio supplied by the fuel-air supply system to the combustion chamber. A feedback control system receives signals from the combustion condition sensor and controls the fuel-air supply to maintain the desired fuel-air ratio.

In accordance with a method for practicing a feature of the invention, the feedback control adjustments are provided with a maximum adjustment amount during which the feedback control is accomplished by step adjustments of the fuel-air ratio by this amount. However, if the engine has been running at a low speed for a long time period, this maximum adjustment amount is enlarged.

In accordance with an apparatus for practicing this facet of the invention, the feedback control includes a maximum adjustment control which limits the maximum step adjustment possible in the fuel-air ratio during feedback control. Means are provided for detecting long periods of low-speed operation, and in response to that condition, the maximum adjustment amount is extended.

Another facet of the invention is adapted to be embodied in a control system that also employs a basic fuel-air ratio setting amount, and the feedback control adjusts that basic ratio. Means are provided for sensing when the engine has operated at a low speed for a long time period, and the basic injection amount is then automatically reduced by a predetermined mount.

In accordance with a method for practicing this facet of the invention, the feedback control system incorporates a basic setting for the fuel-air ratio. However, if the time of running of the engine at a low speed exceeds a predetermined speed, that basic injection amount is decreased.

Another facet of the invention is adapted to be embodied in a method and system for practicing the invention utilizing an engine as described previously having a combustion chamber, a fuel-air supply system, a combustion condition sensor, and a feedback control. In accordance with these features of the invention, the engine is provided with a sensor for sensing at least one engine running condition. An arrangement is provided for accomplishing open control of the engine in response to that sensed engine condition.

In accordance with an apparatus for practicing the invention, means are provided for sensing when the engine has operated at below a predetermined speed for a long period of time under feedback control. When this time period is sensed, the control is switched over to the open control.

In accordance with another facet of the invention as applied to a control method, when the engine has been operated under feedback control and the speed has been below a predetermined speed for a predetermined time period, the control methodology is switched over to an open control.

DETAILED DESCRIPTION OF THE PREFERRED EMBODIMENTS OF THE INVENTION

Figure 1:
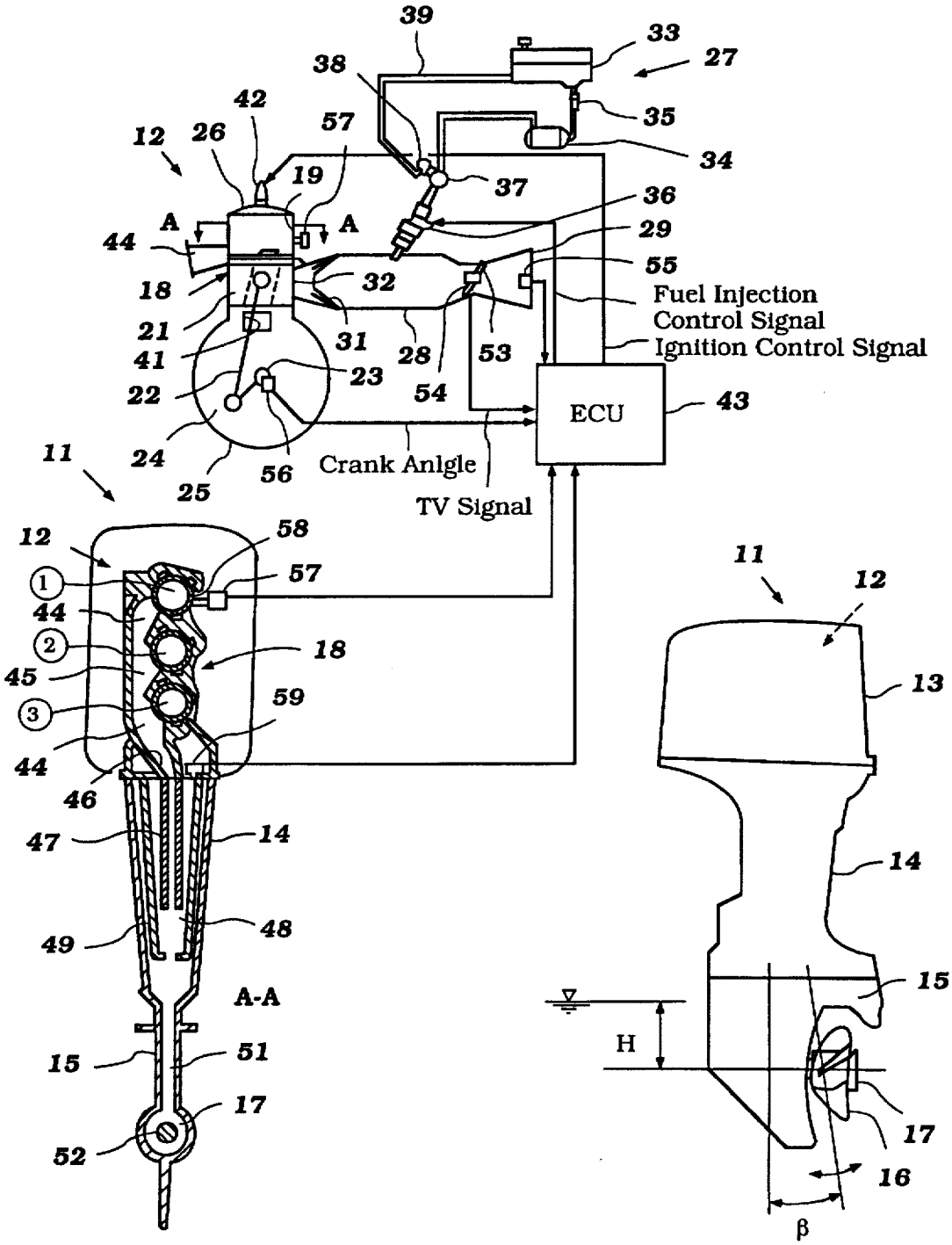
FIG. 1 is a composite view of three figures showing, (1) in the lower right-hand side, a side elevational view of an outboard motor constructed in accordance with an embodiment of the invention; (2) in the lower left-hand side, a cross-sectional view of the outboard motor taken along the line A—A of the upper view and looking generally at the rear of the outboard motor; and (3) in the upper view a partially schematic cross-sectional view taken through a single cylinder of the engine.

Referring now in detail to the drawings and initially to FIG. 1, an outboard motor constructed and operated in accordance with an embodiment of the invention is identified generally by the reference numeral 11. The outboard motor 11 is chosen as an illustrative embodiment of a construction wherein the invention has particular utility. This is in part because outboard motors, as with other marine propulsion units, are frequently operated at low speeds for long periods of time. This happens when trolling, as an example.

The outboard motor 11 is shown in side elevational view in the lower right-hand view and includes a power head that is comprised of a powering internal combustion engine, indicated generally by the reference numeral 12 and which is surrounded by a protective cowling 14.

As will become apparent, the engine 12 is mounted so that its output or crankshaft rotates about a vertically extending axis. This is common practice in outboard motors so as to facilitate coupling of the engine output shaft to a drive shaft (not shown) which is journaled about a vertically extending axis within a drive shaft housing 14 disposed at the lower end of the power head. By having the engine output shaft also rotate about a vertically extending axis, the use of transmissions or other mechanisms for converting horizontal rotation to vertical rotation are eliminated. The drive shaft which depends through the drive shaft housing 14 terminates in a lower unit 15 where a known type of transmission (not shown) drives a propeller 16 in selected forward and reverse directions.

Not shown in this figure but as is typical with outboard motor practice, the outboard motor 11 is mounted for steering movement about a generally vertically extending steering axis and for tilt and trim movement about a generally horizontally extending trim axis. This tilt and trim movement permits trim adjustment of the propeller 12 and its angle of attack through a range as indicated by the angle β in FIG. 1. As is typical in outboard motor and other marine propulsion practice, the exhaust gases from the engine 12 are discharged, in a manner which will be described, through an underwater exhaust discharge, most typically formed in the hub 17 of the propeller. As a result of the trim adjustment through the angle β, the depth of the exhaust gas discharge below the water level as indicated by the dimension H will vary with the trim angle. In addition, the direction of the exhaust gas discharge also will vary from downwardly facing to upwardly facing. Because of this, the back pressure on the engine can vary significantly as the trim angle is adjusted.

Referring now primarily to the left-hand lower and upper views in this figure, the engine 12 is depicted as being of the three cylinder in-line type. Although the invention is described in conjunction with such an arrangement, it will be readily apparent to those skilled in the art how the invention can be practiced with engines having other cylinder numbers and other cylinder configurations. Also, the engine 12 operates on a two-cycle crankcase compression principle. Again, however, it will be readily apparent to those skilled in the art how the invention can be employed with engines operating on four-stroke principles.

Since the actual internal details of the engine 12 form no significant portion of the invention, the engine 12 has been depicted generally in schematic form and will be described only generally. Those skilled in the art can readily refer to any known prior art type of constructions for examples of engines with which the engine may be practiced.

The engine 12 includes a cylinder block 18 in which three horizontally disposed cylinder bores are formed. The cylinder bores are indicated by the reference numeral 19 and are vertically spaced from each other so as to provide the in-line construction as aforenoted. The cylinders are numbered 1, 2, and 3 beginning at the uppermost end as shown by the reference characters in the lower left-hand view of FIG. 1.

Pistons 21 reciprocate in each of the cylinder bores 19 and are connected by means of connecting rods 22 to a crankshaft 23. The crankshaft 23 rotates, as aforenoted, about a vertically extending axis within a crankcase chamber 24 formed by a crankcase member 25 that is affixed to the cylinder block 18 and by the skirt of the cylinder block 18. As is typical with two-cycle crankcase compression engines, the crankcase chambers 22 associated with each of the cylinder bores 19 are sealed from each other in any suitable manner.

A cylinder head 26 is affixed to the cylinder block 18 on the side opposite the crankcase member 25. The cylinder head 26 has individual recesses which cooperate with the cylinder bores 19 and pistons 21 to form the individual combustion chambers of the engine.

A fuel and air charge forming system, indicated generally by the reference numeral 27, is provided for delivering a fuel/air charge to these combustion chambers. This system includes an air intake manifold 28 which is shown schematically and which has an atmospheric air opening 29 that receives atmospheric air from within the protective cowling 13. As is well known in this art, the protective cowling 13 is provided with a suitable atmospheric air inlet to permit air to enter its interior for engine operation.

The intake manifold 28 has a plurality of individual runners, one for each crankcase chamber 24 in which reed-type check valves 31 are provided. The reed-type check valves 31 permit air and fuel, as will become apparent, to enter the crankcase chambers 24 through adjacent intake ports 32 when the pistons 21 are moving upwardly in the cylinder bores 19 and the volume of the crankcase chamber 24 is increasing. However, as the pistons 18 move downwardly, the check valves 31 will close and permit the charge to be compressed in the crankcase chambers 24.

In addition to the air as thus far described, fuel is also mixed by the system 27 with the air charge inducted into the crankcase chambers 24. The illustrated embodiment depicts a manifold-type injection system for this purpose. It will be readily apparent to those skilled in the art, however, that this invention may be employed in conjunction with engines having other types of fuel supply systems including direct cylinder injection.

The fuel supply system includes a remotely positioned fuel tank 33 from which fuel is drawn by means of a pump 34 through a filter 35. This fuel is then delivered to individual fuel injectors 36 each of which sprays into a respective one of the runners of the intake manifold 28. A fuel rail 37 connects the fuel supply system to the injectors 36 in a well known manner.

A pressure control valve 38 is provided in the fuel rail 37 and regulates the pressure of the fuel supplied to the injectors 36 by dumping excess fuel back to the fuel tank 33 or some other position in the fuel supply system through a return conduit 39.

Thus, because of the manifold injection system described, a fuel/air mixture is introduced into the crankcase chambers 24 and is compressed, as aforenoted. The compressed charge is then transferred to the combustion chambers through one or more scavenge passages 41. This charge is then further compressed in the combustion chamber and is fired by means of spark plugs 42.

The spark plugs 42 are fired by an ignition system under the control of an ECU, indicated generally by the reference numeral 43. The ECU 43 also controls the timing and duration of fuel injection from the injectors 36. It should be noted that the injectors 36 illustrated are of the electrically operated, solenoid type although other types of injectors may also be employed.

As the spark plugs 42 fire, the fuel/air charge in the combustion chambers will burn and expand to drive the pistons 21 downwardly and drive the crankshaft 23 as is well known in this art.

The exhaust gases from combustion are discharged through an exhaust system to the aforenoted underwater exhaust discharge in a manner which will now be described. Each cylinder bore 19 is provided with a respective exhaust port 44 which exhaust ports 44 communicate with an exhaust manifold 45 that is formed in part integrally within the cylinder block 18, as is also typical with outboard motor practice. This exhaust manifold 45 terminates in a downwardly facing discharge opening 46 which communicates with the upper end of an exhaust pipe 47. The exhaust pipe 47 discharges into an expansion chamber 48 formed by an inner shell 49 of the drive shaft housing 14 for silencing purposes. The exhaust gases then flow downwardly through an exhaust passage 51 formed in the lower unit 15 for discharge through the hub discharge port 17 around a propeller shaft 52 which drives the propeller 16, as aforenoted.

The compact nature of the exhaust system has the aforenoted effects of causing the pressure conditions at the exhaust ports of the cylinders 1, 2 and 3 to vary significantly.

As has been noted, the ECU 43 operates so as to control not only the timing of the firing of the spark plugs 42 but also the timing and duration of fuel injection from the fuel injectors 36. For this purpose, the ECU receives certain signals from engine operating and ambient conditions. Only certain of those signals will be described because it is believed within the scope of those skilled in the art to understand that various types of control strategies may be employed. The invention deals primarily with the feedback control system and an open control system utilized in some circumstances and the transitions between these two controls.

In order to control the speed of the engine 12 there is provided a throttle valve 53 which is interposed in the air inlet 29 of the induction and charge forming system 27 for controlling the air flow to the engine. A throttle position sensor 54 is associated with the throttle valve 53 and outputs a throttle valve position signal to the ECU 43. This signal is in essence a load demand signal on the engine. In addition, an air flow sensor 55 is mounted in the atmospheric air inlet opening 29 so as to provide a signal representative of the amount of intake air to the ECU 53. A crank angle sensor 56 is associated with the crankshaft 23 and outputs a crank angle signal to the ECU 43. This crank angle signal permits the ECU 43 to determine the angular position of the crankshaft for timing of the firing of the spark plugs 42 and for injection of fuel from the injectors 36. Also by counting the number of pulses generated by the sensor 56 in a given time period, the engine speed may also be calculated.

The system further includes, as has been noted, a feedback control system and therefore a combustion condition sensor indicated by the reference numeral 57 is provided. In the illustrated embodiment, the combustion condition sensor 57 constitutes an oxygen ($O_2$) sensor which communicates with the exhaust port of one of the cylinders (cylinder#1) through a sensing port 58. The oxygen sensor outputs a signal indicative of the density of the oxygen in the exhaust gases. As is well known, this signal can be utilized to determine the actual fuel/air ratio in the engine. More specifically, it may be utilized to determine if the fuel/air ratio is stoichiometric, i.e., $\lambda=1$.

As has been noted, the desired fuel/air ratio also will depend upon exhaust back pressure and this is measured by a back pressure sensor 58 that communicates with the expansion chamber 48 to provide a back pressure signal to the ECU 43. Other factors which effect back pressure such as trim angle, etc., may also be supplied. As has been previously noted, still further ambient and engine running conditions may be utilized in the overall fuel/air ratio control for the engine.

With the engine control supplied by the ECU 43, and specifically the normal feedback control using the output of the oxygen sensor 57, the ECU may follow any desired control strategy. However, basically the strategy is that the Output of the oxygen sensor 57 is employed by the ECU 43 so as to adjust the duration of injection by the fuel injector 36 so as to maintain the desired fuel-air ratio, which is normally stoichiometric, i.e., $\lambda=1$. This is done, for the most part, by setting a basic fuel injection amount and then detecting the output of the sensor 57 and adjusting this basic amount to maintain the desired amount. Insofar as this basic control strategy is concerned, any control strategy known in the art may be employed.

The invention deals, as is noted, with the situation where the engine has been operating at a low speed for a long time period. Therefore, only this phase of the engine control will be described, although this also involves some reference to the basic engine control. Thus, where any portions of the strategy of the basic engine control are not described, any of those known in the art may be utilized.

As should be apparent from the foregoing description, one particular situation in which the conventional feedback control systems may admit to improvement is during initial startup, and particularly where the initially started engine is operated at a low speed for a long time period. This is common with outboard motors such as the outboard motor 11 where the engine 12 may be initially started and operated at trolling speeds for a fairly long time period.

Figure 2:
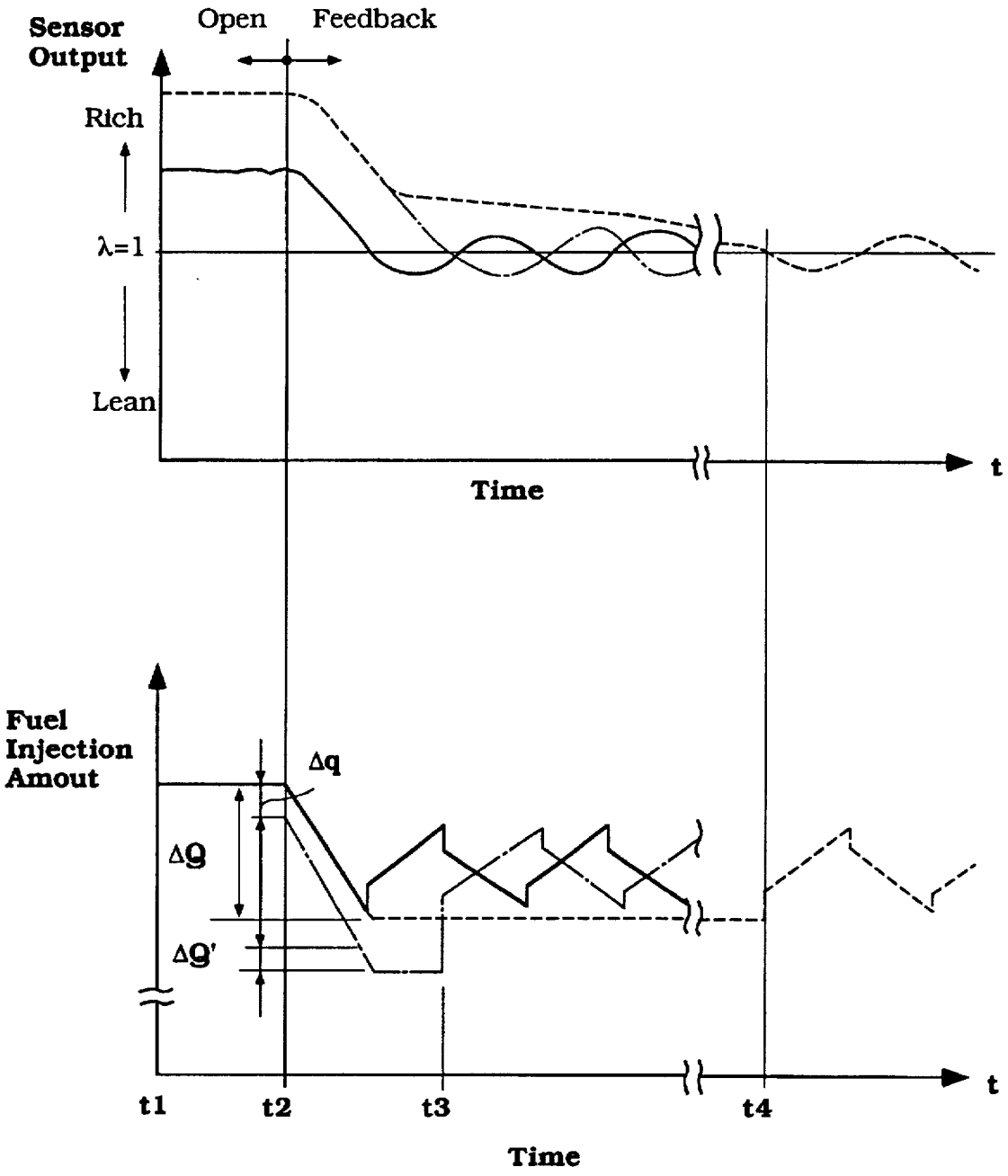
FIG. 2 is a graphical view showing the time period when the engine is switched over from an open control to a feedback control, and depicts the output of the combustion condition sensor and the resulting amount of fuel injected, both with a normal condition and under a condition when the engine has been running at a low speed for more than a predetermined time period to depict several features of the invention.

Referring specifically now to FIG. 2, the solid-line curves of this figure indicate the running conditions under normal running. Considering first the sensor output, when the sensor reaches a normal condition, it will output a signal, and this signal may be initially rich under open control. When switching over to feedback control at the time t2, the rich signal will be recognized, and a step adjustment in the amount of fuel injection of the amount $\Delta Q$ will occur. Subsequent adjustments, if desired, will not be made until after a certain time period. That is, the normal feedback control system operates so as to make a large adjustment and then wait a time period before subsequent adjustments are made. As a result of this, the time period before which the engine will return to the normal desired stoichiometric or $\Lambda 1$ condition will be delayed to the time t4, as shown by the broken-line curve in the top portion of this figure.

In accordance with this invention, therefore, two things are done. First, when the mixture is rich for a time period such as the time period t1–t2 and the engine speed is lower than a predetermined value, which predetermined value may be idle speed or a speed slightly above or slightly below idle speed, then the program automatically creates a reduction in the amount of fuel injection of the amount $\Delta q$.

If then at the time period t2 the mixture is still rich, then a large reduction in fuel supply of an amount $\Delta Q'$ is made. This amount is $\Delta Q$ plus a further incremental amount. Thus, the fuel-air ratio will be brought to the stoichiometric or desired ratio much quicker, at the time period t3 rather than the previous time period t4. Thus, much better engine control is achieved along with better running, and improved performance.

Although this condition has been described in conjunction with a normal startup, it also may occur during subsequent running, such as a return to idle or speeds lower than the predetermined speed after fast running.

Figure 3:
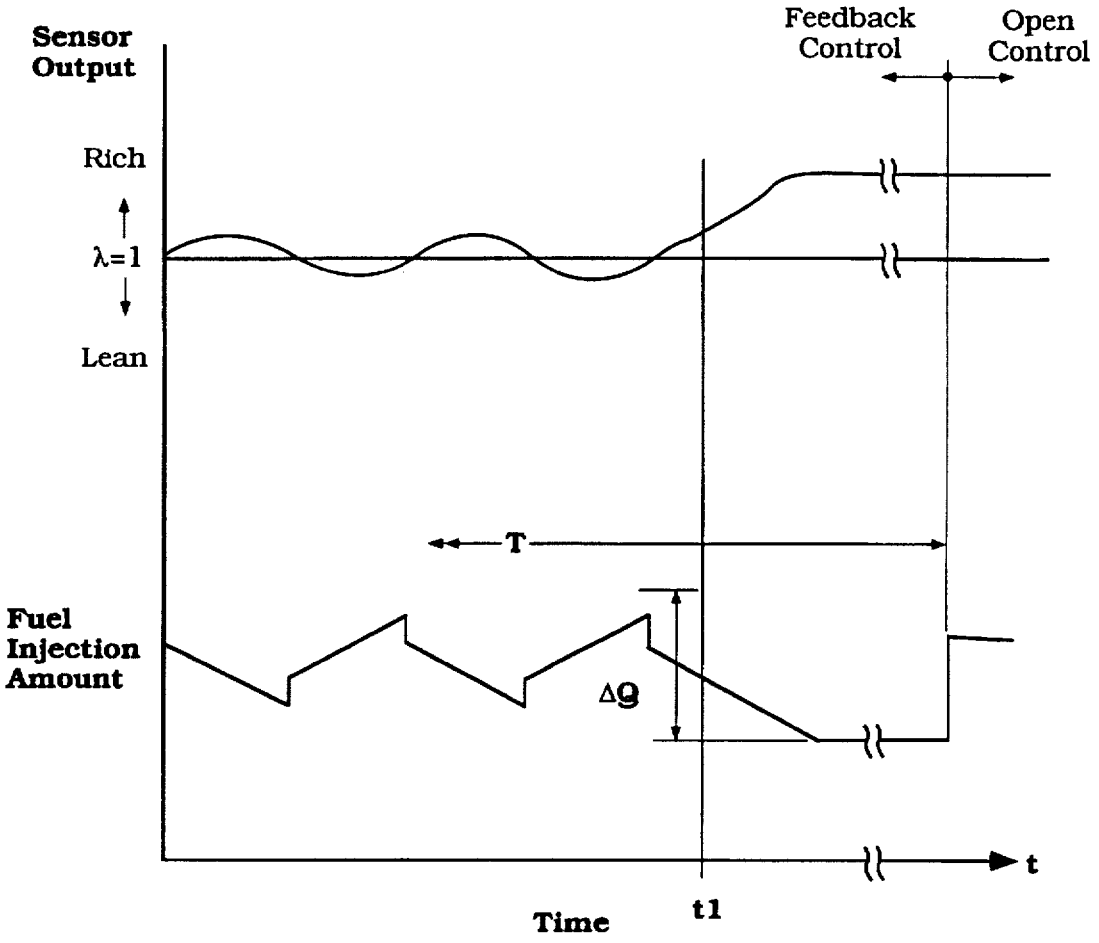
FIG. 3 is a graphical view also showing sensor output and fuel injection amount, but under a condition when the engine has been running under feedback control for a long time period and the engine has been operating at lower than a predetermined speed for this time period.

FIG. 3 shows another embodiment or feature of the invention. This deals with a steady-state condition wherein the engine has been operating normally and the sensor has been operating appropriately. Thus, the system has been operating under feedback control. However, if the engine 12 has its speed reduced below the predetermined level or actually at any of a wide variety of low speeds, the sensor may cease to function properly.

As seen in FIG. 3, if the engine speed is run for a long time at a low speed, at some point such as the point t1, the sensor output may become erratic. This can be caused either by the sensor becoming fouled by carbon deposits or other deposits, or because the temperature of the sensor drops below its operating temperature. When these situations occur, the sensor then may give out a constant rich signal that will not vary. In accordance with the invention, therefore, a procedure is initiated where the normal feedback control making adjustments in the range $\Delta Q$ is switched over to an open control at a time period T after the beginning of the elongated idle or low-speed running condition.

As may be seen, at the point t1 the fuel injection amount is decreased by the amount $\Delta Q$, and yet there is no change or reduction in the sensor output. Therefore, the system is switched over to an open control, and this open control will continue. Once the engine speed is returned to a normal engine speed and after a predetermined time, the sensor 57 should clear itself, and the system can then return back to feedback control.

Figure 4:
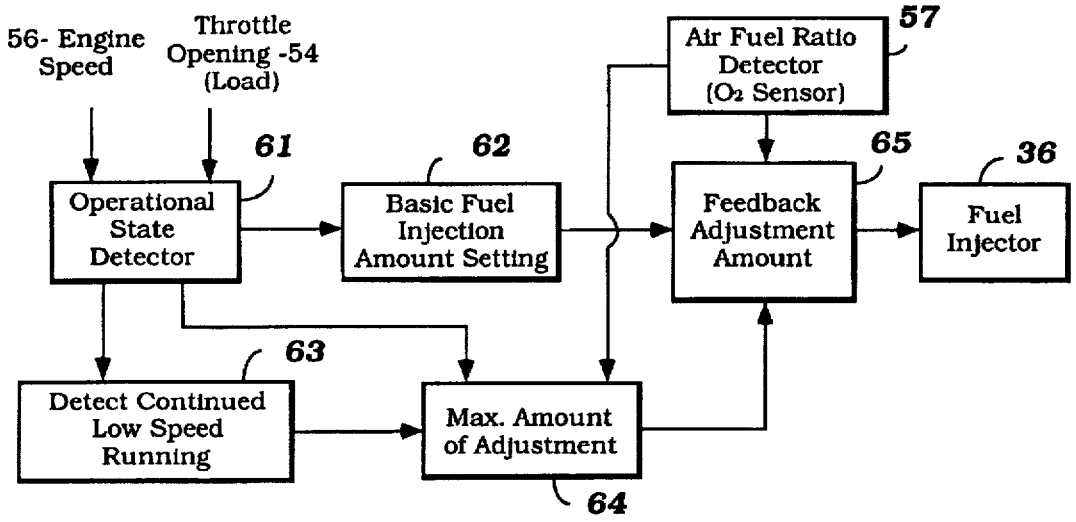
FIG. 4 is a block diagram showing the interrelationship between the controlled components in order to accomplish one of the control strategies depicted in FIG. 2.
Figure 5:
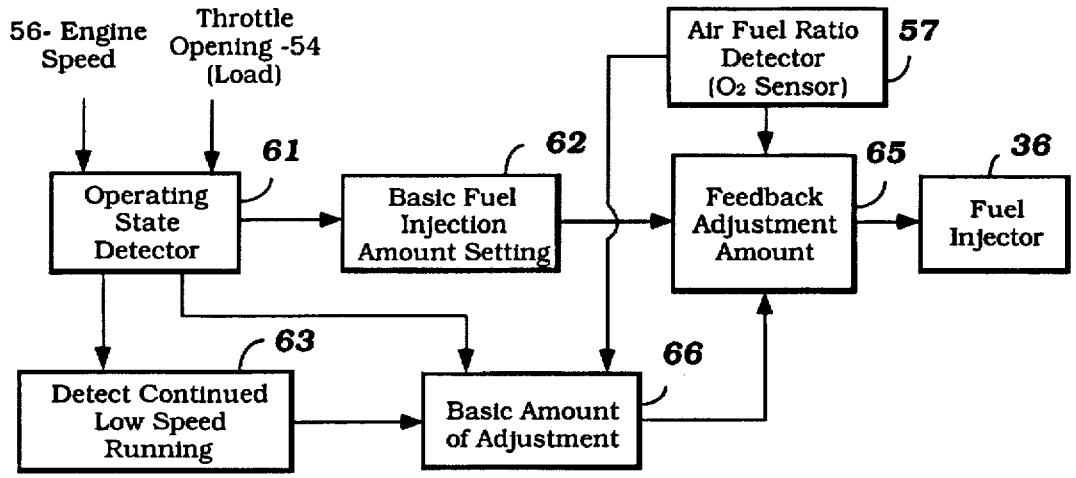
FIG. 5 is a block diagram, in part similar to FIG. 4, and shows another relationship of the components to practice the other feature depicted in FIG. 2.
Figure 6:
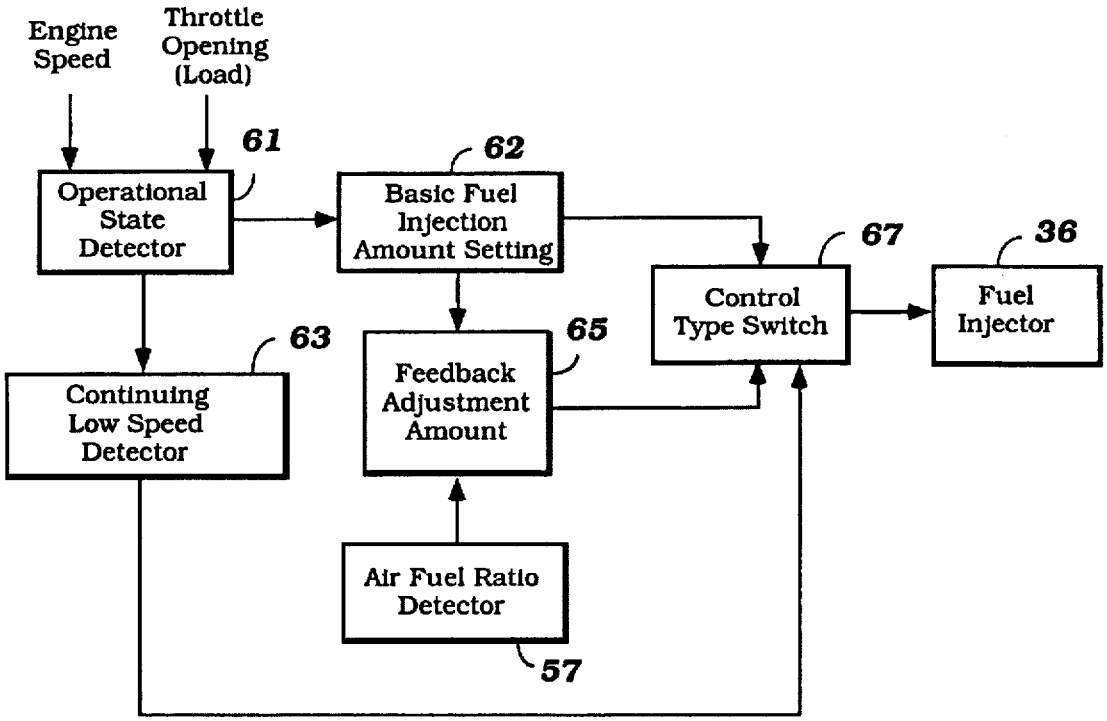
FIG. 6 is a block diagram showing the relationship of the components in order to provide the control routine shown in FIG. 3.

FIGS. 4–6 are block diagrams of the control components and show how they are interrelated to provide the results which have been described. These will now be detailed by particular reference to these figures and starting first with FIG. 4.

As may be seen, the system includes an operational state detector portion of the ECU 43, which operational state detector portion is indicated generally by the reference numeral 61. This detector receives certain signals indicative of engine running conditions. In the specific embodiment illustrated, these running conditions are engine speed and load. Engine speed is determined by counting the output pulses from the crankshaft position sensor 56 in a given time period so as to provide a rotational speed signal. Engine load is determined, in this embodiment, by the position of the throttle valve 53, as sensed by the throttle position sensor 54.

The operational state detector 61 outputs its signal to two different units. The first of these is a basic fuel mount injection setting unit 62 which sets an mount of fuel to be supplied to the fuel injector for the basic engine running condition.

The operational state detector 61 also outputs an indication of engine speed to a detector section 63 that detects continued low-speed running for a given predetermined time period. As has been noted, the speed may be any selected speed, such as idle speed or a speed close to idle speed, and the time may be determined from actual engine measurements of when the time is such that the control mode should be shifted.

The outputs of the operational state detector 61 and continued low-speed running detector 63 are both output to a maximum adjustment amount setting means 64. This setting means 64, in accordance with the method shown in FIG. 2, sets the amounts $\Delta Q$ and $\Delta Q'$.

The outputs from both the basic fuel injection amount setter 62 and the maximum adjustment amount setter 64 are transmitted to a feedback adjustment control amount section 65. This section 65 also receives the signal from the fuel-air ratio detector 57.

Therefore, under normal engine feedback control running conditions, the operational state detector 61 outputs the signal of the engine condition to the basic fuel amount setter 62. The fuel-air ratio detector 57 then sets out whether the mixture is rich or lean, and outputs this signal to the feedback adjustment amount 65. This section then determines from the maximum amount adjustment setter 64 the adjustment to be made, and sends the appropriate signal to the injector 36 for controlling the amount of fuel injection.

If the engine has been run in a long period of operation at low speed, the maximum amount adjustment receives the signal from the continued low-speed running detector 63 and resets the maximum amount of fuel injection as noted.

FIG. 5 shows the elements for the control strategy wherein the adjustment of the mount ΔQ is made in the event of continued low-speed running. This system is the same as that of FIG. 4, but acids a basic adjustment amount section 65. Thus, when the continued speed is sensed, the basic amount of adjustment setter 66 outputs a signal to the feedback adjustment amount 65 so as to reduce the amount of fuel injected by the mount Δq.

FIG. 6 shows the interrelationship of the components in order to achieve the method and system of FIG. 3 wherein the unit shifts between feedback control and open control. In this arrangement the outputs of the basic fuel injector mount setter 62 and the feedback adjustment amount setter 65 go to a control-type switch 67, which then determines which system's output will be transmitted to the fuel injector 36. This decision is made by the output of the continuing low-speed detectors 63 in the manner already described.

Therefore, it should be readily apparent to those skilled in the art that the described method and apparatus ensures good feedback control and also good transition between feedback control and open control with rapid stabilization regarding which system of control is employed. Of course, the foregoing description is that of preferred embodiments of the invention. Those skilled in the art will readily understand how various changes and modifications may be made without departing from the spirit and scope of the invention, as defined by the appended claims.

What is claimed is:

1. A control system for an internal combustion engine having a combustion chamber, a fuel-air supply system for delivering a fuel and air charge to said combustion chamber, a combustion condition sensor for determining the fuel-air ratio supplied by said fuel and air supply system to said combustion chamber, means for detecting at least one engine running condition and means for setting a basic fuel-air ratio in response to that sensed engine condition, a feedback control system for receiving signals from said combustion condition sensor and controlling said fuel-air supply to maintain the desired fuel-air ratio by modifying said basic fuel air ratio, and means for reducing the basic injection amount when the engine speed is outside of a predetermined range for a predetermined time.

2. A control method for an internal combustion engine having a combustion chamber, a fuel-air supply system for delivering a fuel and air charge to said combustion chamber, a combustion condition sensor for determining the fuel-air ratio supplied by said fuel and air supply system to said combustion chamber, said method comprising the steps of detecting at least one engine running condition, setting a basic fuel-air ratio in response to that sensed engine condition, receiving signals from said combustion condition sensor and controlling said fuel-air supply to maintain the desired fuel-air ratio by modifying said basic fuel air ratio, and reducing the basic injection amount when the engine speed is outside of a predetermined range for a predetermined time.

3. A control system for an internal combustion engine having a combustion chamber, a fuel-air supply system for delivering a fuel and air charge to said combustion chamber, a combustion condition sensor for determining the fuel-air ratio supplied by said fuel and air supply system to said combustion chamber, means for detecting at least one engine running condition and means for setting a basic fuel-air ratio in response to that sensed engine condition to provide an open engine control, a feedback control system for receiving signals from said combustion condition sensor and controlling said fuel-air supply to maintain the desired fuel-air ratio by modifying said basic fuel air ratio, and means for switching between feedback control and open control in response to operation of the engine outside of a certain predetermined speed for more than a predetermined time.

4. A control system as set forth in claim 3, wherein the open control is initiated when the engine speed is below a predetermined speed for a predetermined time period.

5. A control method for an internal combustion engine having a combustion chamber, a fuel-air supply system for delivering a fuel and air charge to said combustion chamber, a combustion condition sensor for determining the fuel-air ratio supplied by said fuel and air supply system to said combustion chamber, said method comprising the steps of detecting at least one engine running condition, setting a basic fuel-air ratio in response to that sensed engine condition to provide an open engine control, receiving signals from said combustion condition sensor and controlling said fuel-air supply to maintain the desired fuel-air ratio by modifying said basic fuel air ratio, and switching between feedback control and open control in response to operation of the engine outside of a certain predetermined speed for more than a predetermined time.

6. A control method as set forth in claim 5, wherein the open control is initiated when the engine speed is below a predetermined speed for a predetermined time period.

7. A control system for an internal combustion engine having a combustion chamber, a fuel-air supply system for delivering a fuel and air charge to said combustion chamber, a combustion condition sensor for determining the fuel-air ratio supplied by said fuel and air supply system to said combustion chamber, a feedback control system for receiving signals from said combustion condition sensor and controlling said fuel-air supply to maintain the desired fuel-air ratio, said feedback control system being effective to change the fuel-air ratio in incremental steps in response to indication of necessity of change from the output of said combustion condition sensor, means for detecting the engine running speed, and means for increasing the amount of the incremental steps of fuel-air adjustment in response to the detection of an engine speed outside of a predetermined range and longer than a predetermined time period.

8. A control system as set forth in claim 7, wherein the incremental adjustment amount is increased when the engine speed is below a predetermined speed for a predetermined time period.

9. A control system as set forth in claim 7, wherein the engine further includes means for detecting at least one engine running condition and means for setting a basic fuel-air ratio in response to that sensed engine condition, the feedback control adjusting the basic fuel-air ratio in response to the output of the combustion condition sensor.

10. A control system as set forth in claim 9, wherein the basic injection amount is reduced also when the engine speed is outside of a predetermined range for a predetermined time.

11. A control system as set forth in claim 10, wherein the incremental adjustment amount is reduced when the engine speed is below a predetermined speed for a predetermined time period.

12. A control system as set forth in claim 7, wherein the engine further includes means for detecting at least one engine running condition and means for setting a basic fuel-air ratio in response to that sensed engine condition, the feedback control adjusting the basic fuel-air ratio in response to the output of the combustion condition sensor and further including means for switching between feedback control and open control in response to a predetermined condition.

13. A control system as set forth in claim 12, wherein the predetermined condition is operation of the engine outside of a certain predetermined speed for more than a predetermined time.

14. A control system as set forth in claim 13, wherein the open control is initiated when the engine speed is below a predetermined speed for a predetermined time period.

15. A control system as set forth in claim 14, wherein the basic injection amount is reduced also when the engine speed is outside of a predetermined range for a predetermined time.

16. A control system as set forth in claim 15, wherein the incremental adjustment amount is reduced when the engine speed is below a predetermined speed for a predetermined time period.

17. A control method for an internal combustion engine having a combustion chamber, a fuel-air supply system for delivering a fuel and air charge to said combustion chamber, a combustion condition sensor for determining the fuel-air ratio supplied by said fuel and air supply system to said combustion chamber, a feedback control system for receiving signals from said combustion condition sensor and controlling said fuel-air supply to maintain the desired fuel-air ratio, said feedback control system being effective to change the fuel-air ratio in incremental steps in response to indication of necessity of change from the output of said combustion condition sensor, said method comprising the steps of detecting the engine running speed, and increasing the amount of the incremental steps of fuel-air adjustment in response to the detection of an engine speed outside of a predetermined range and longer than a predetermined time period.

18. A control method as set forth in claim 17, wherein the incremental adjustment amount is increased when the engine speed is below a predetermined speed for a predetermined time period.

19. A control method as set forth in claim 17, wherein the engine further includes means for detecting at least one engine running condition and further including the step of setting a basic fuel-air ratio in response to that sensed engine condition, the feedback control adjusting the basic fuel-air ratio in response to the output of the combustion condition sensor.

20. A control method as set forth in claim 19, wherein the basic injection amount is reduced also when the engine speed is outside of a predetermined range for a predetermined time.

21. A control method as set forth in claim 20, wherein the incremental adjustment mount is reduced when the engine speed is below a predetermined speed for a predetermined time period.

22. A control method as set forth in claim 17, wherein the engine further includes means for detecting at least one engine running condition and further including the step of setting a basic fuel-air ratio in response to that sensed engine condition, the feedback control adjusting the basic fuel-air ratio in response to the output of the combustion condition sensor, and switching between feedback control and open control in response to a predetermined condition.

23. A control method as set forth in claim 22, wherein the incremental adjustment mount is reduced when the engine speed is below a predetermined speed for a predetermined time period.

24. A control method as set forth in claim 22, wherein the predetermined condition is operation of the engine outside of a certain predetermined speed for more than a predetermined time.

25. A control method as set forth in claim 24, wherein the open control is initiated when the engine speed is below a predetermined speed for a predetermined time period.

26. A control method as set forth in claim 25, wherein the basic injection amount is reduced also when the engine speed is outside of a predetermined range for a predetermined time.

* * * * *